US005571004A

United States Patent [19]

Masters et al.

[11] Patent Number: 5,571,004

[45] Date of Patent: Nov. 5, 1996

[54] SLIDING VANE ROTOR ATTACHMENT

[75] Inventors: Stephen D. Masters, Rayville; Meredith W. Meece, Monroe, both of La.

[73] Assignee: Thomas Industries Inc., Monroe, La.

[21] Appl. No.: 537,494

[22] Filed: Oct. 2, 1995

[51] Int. Cl.[6] ..... F01C 19/00

[52] U.S. Cl. ..... 418/107; 418/259

[58] Field of Search ..... 418/107, 270, 418/259

[56] References Cited

U.S. PATENT DOCUMENTS

| | | | |
|---|---|---|---|
| 1,884,974 | 10/1932 | Hurd . | |
| 2,434,979 | 1/1948 | Bergh . | |
| 3,034,443 | 5/1962 | Hinrichs et al. . | |
| 3,164,097 | 1/1965 | Nicoll . | |
| 3,642,389 | 2/1972 | Chambers et al. | 418/107 |
| 3,804,562 | 4/1974 | Hansson | 418/107 |
| 4,080,094 | 3/1978 | Jeter . | |
| 4,281,942 | 8/1981 | Gaeckle et al. . | |
| 4,328,856 | 5/1982 | Cunningham . | |

*Primary Examiner*—Charles Freay
*Attorney, Agent, or Firm*—Quarles & Brady

[57] ABSTRACT

An adjustable attachment for connection of a rotor to a shaft which provides precise axial positioning of the rotor with respect to a motor housing. The adjustment is effected by a screw mounting of the rotor on the shaft and spring discs placed in a compartment in the motor housing with a shaft spacer placed between the rotor and the discs. The adjustment feature is especially adapted for use in conjunction with sliding vane type vacuum pumps, compressors and air motors.

5 Claims, 2 Drawing Sheets

SLIDING VANE ROTOR ATTACHMENT

BACKGROUND OF THE INVENTION

1. Field Of The Invention

This invention relates to attachments of a rotor to a shaft wherein the axial positioning of the rotor in relation to a housing is important. More particularly, the invention relates to attaching a vane type rotor to a motor shaft of a vacuum pump, air compressor or air motor.

2. Discussion Of The Prior Art

Prior methods of attaching a rotor to a shaft include pressing the rotor onto a shaft, adhesive bonding, pressing the rotor over an expanded metal ring located on a shaft groove, and securing the rotor to a shaft by using a set screw that tightens the rotor against a flat on the motor shaft. All of these methods have drawbacks which include the difficulty of setting an end clearance between the rotor and the motor housing, distortion of vane slots, rotor out of roundness when pressing over the motor shaft and inadequate bonding strength when using adhesives.

It is also known in the art to provide an adjustment for the clearance between an impeller and its housing wall by axially adjusting the position of the impeller shaft. This is disclosed in U.S. Pat. Nos. 2,434,979; 3,034,443; and 3,164,097. In U.S. Pat. Nos. 1,884,974; 4,080,094; 4,281,942; and 4,328,856, springs are utilized to provide an axial biasing force on a rotary shaft.

For sliding vane vacuum pumps, compressors, and air motors, to minimize leakage past the axial ends of the vanes and between the end of the rotor and the housing, it is desirable to provide a very small clearance between the rotor and the end wall of the motor housing. The attachment should be simple, economical, reliable and easy to assemble, while allowing accurate axial positioning of the rotor relative to the housing, so as to minimize leakage. The present invention addresses this need in the art.

SUMMARY OF THE INVENTION

In one embodiment, the present invention includes an adjustable attachment for connection of a sliding vane rotor to a shaft wherein a motor has a housing with a compartment therein and a shaft extending from the housing. A biasing member is positioned in the compartment, and a shaft spacer is positioned between the rotor and the biasing member. A threaded fastener axially connects the rotor to the shaft. The biasing member, shaft spacer and threaded fastener are constructed and arranged so that when the fastener is turned, the rotor forces the shaft spacer to compress the biasing member, to thereby adjust a spacing between the motor housing and the rotor.

In a preferred embodiment, the fastener is a screw, and the biasing member includes at least one and preferably two spring discs.

The invention thereby provides an improved adjustable attachment for connection of a sliding vane rotor to a shaft which provides for precise axial positioning and adjustment of the rotor relative to the housing. The invention accomplishes this in an adjustable attachment of the foregoing type which obviates the problems associated with prior methods of rotor attachment, which is particularly suited for use in conjunction with rotary vane vacuum pumps, compressors and air motors.

The foregoing and other objects and advantages of the invention will appear from the following description. In the description, reference is made to the accompanying drawings in which there is shown by way of illustration a preferred embodiment of the invention.

DETAILED DESCRIPTION OF THE PREFERRED EMBODIMENTS

Figure 1:
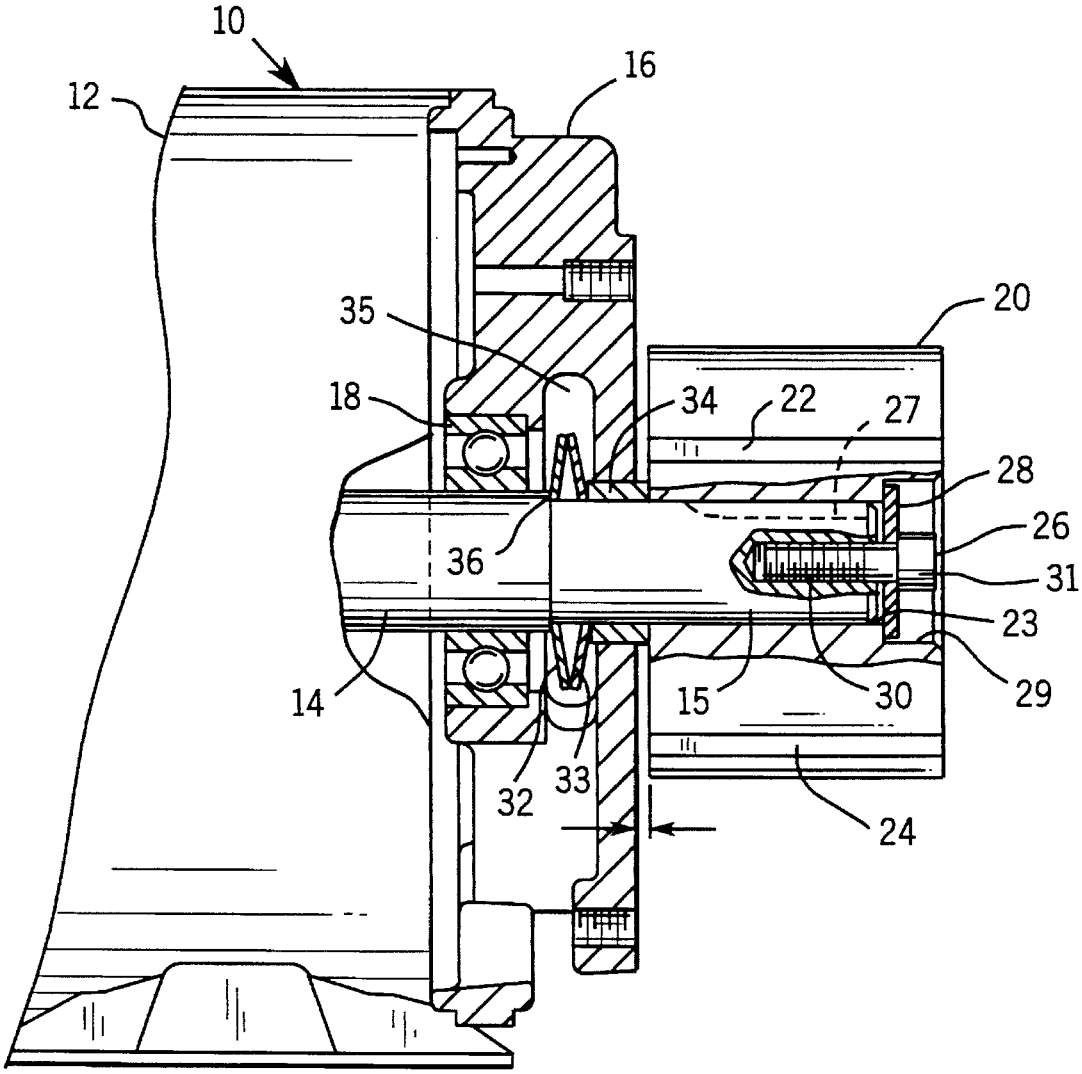
FIG. 1 is a view in side elevation with parts shown in cross section illustrating the adjustable attachment for a rotor shaft in accordance with this invention.
Figure 2:
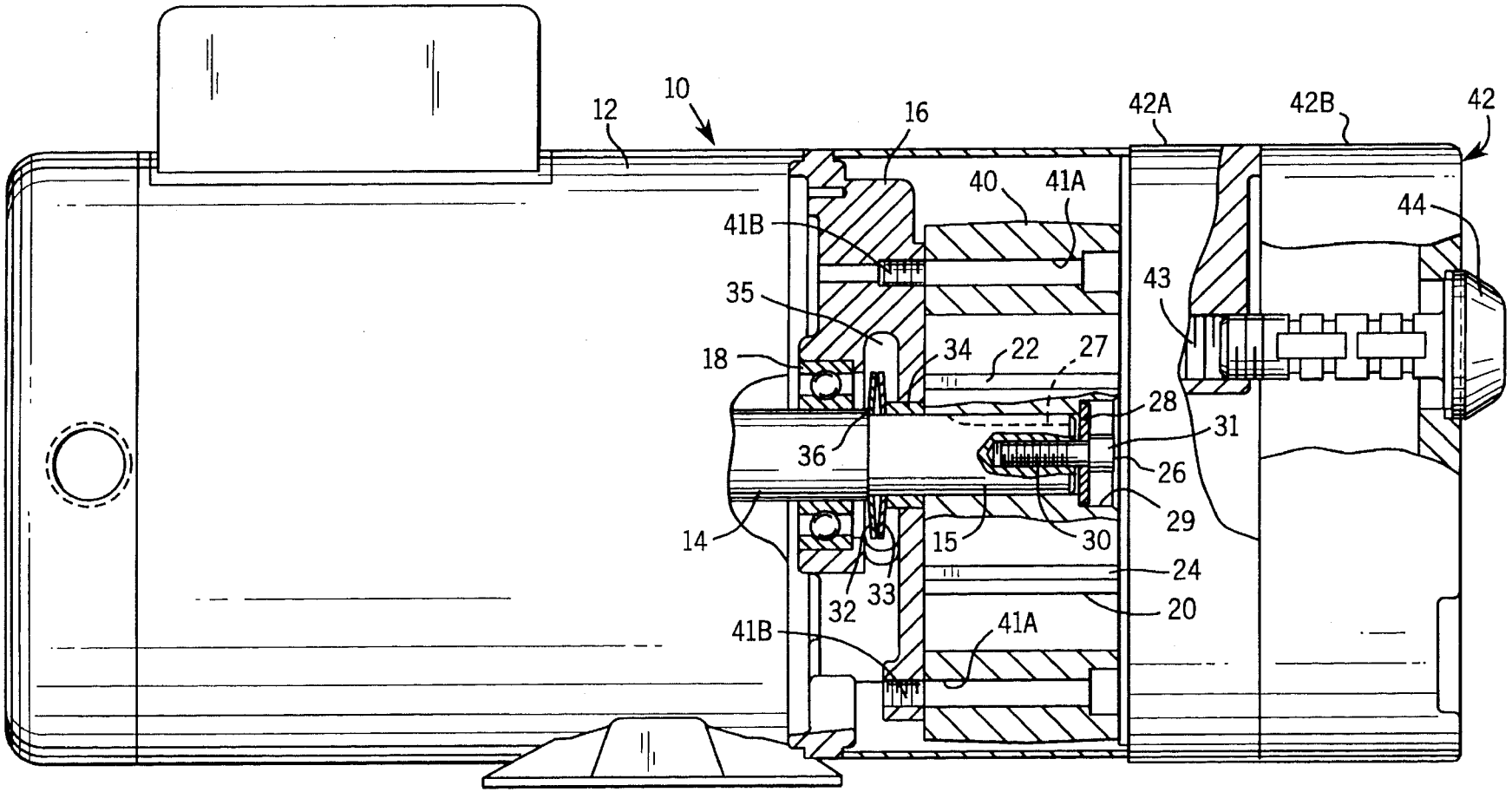
FIG. 2 is a view similar to FIG. 1 illustrating a different position of the rotor.

Referring to FIGS. 1 and 2 of the drawings, a vacuum pump, generally 10, is shown having the usual electric motor 12 for driving a shaft 14 which is journalled in the housing end shield 16 by a bearing 18. A rotor 20 of the sliding vane type, having slots 22 and 24 for slidably receiving vanes in well known manner, is coaxially attached to the shaft 14 by a coaxial screw 26 having threads 30 and a head 31. Rotor 20 has bore 23 in which shaft 14 is slidably received and an enlarged counterbore 29 at its end which is distal from the motor end shield 16. A keyway 27 may be provided in the end 15 of the shaft 14 and in the rotor 20 (keyway in rotor not shown) to fix the rotor and shaft so that they rotate together, but are axially slidable relative to one another. The screw 26 extends through annular washer 28, which abuts on one face the head 31 of screw 26 and abuts on its other face a shoulder of the rotor 20 which is created by counterbore 29.

There is a compartment 35 in the motor housing shield 16 for accommodating two spring discs 32 and 33 which are positioned in face-to-face relationship in compartment 35 of housing 16 so as to increase the spring travel. Preferably spring discs 32 and 33 are belleville spring washers. The biasing elements could possibly be a helical compression spring or other type of biasing element. Spring disc 32 is in contact with a shoulder 36 on shaft 14, whereas spring disc 33 contacts an annular shaft spacer 34 which is slidably received on shaft 14 and compressed between disc 33 and rotor 20 so as to rotate with shaft 14. The inner radius of spacer 34 is in close proximity to the shaft 14 and the outer radius of the spacer 34 is in close proximity to the end shield 16, to inhibit leakage at those interfaces.

Referring specifically to FIG. 2, the sliding vane rotor 20 rotates in the usual manner eccentrically positioned in a cylinder 40, which is secured to the motor housing 16 by screws (not shown) which extend through bores 41A in cylinder 40 and which are threaded into bores 41B in the motor housing 16.

As is well known, the pump housing, which includes the end shield 16, cylinder 40 and head 42, has an inlet port and an outlet port for creating a pressure difference from the inlet port to the outlet port, such as for drawing a vacuum for the recovery of vaporous materials. The head 42 is made in a conventional two-part construction, which includes end plate 42A and a sound chamber 42B, and is attached to the cylinder 40 by any suitable means such as screws or bolts (not shown). As is well known, the interior of the sound chamber 42B is divided into an inlet chamber and an outlet chamber which are sealed from one another. Each chamber has a filter holder 44 extending through it (for a total of two holders 44, only one shown). Each holder has a perforated tubular shank and annular discs of filter material, e.g., felt (not shown), are coaxially stacked on the shank to filter air as it enters the cylinder 40 and as it exits the cylinder 40. Inlet and outlet ports (one partially shown at 43 in FIG. 2) are formed in the end plate 42A which are coaxial with the respective filter holders 44 and communicate with the interior of the cylinder 40. The filter holders 44 are screwed into these ports, as shown by the threads on the end on the shank of the holder 44 in FIG. 2. However, it should be understood that any suitable type of head and filter arrangement may be used to practice the invention.

The novel adjustment feature for the rotor 20 on shaft 14 is illustrated by comparing the distance that rotor 20 is from the end of the motor housing 16 as seen in FIG. 1 and as seen in FIG. 2. In FIG. 1, there is a relatively large distance between the rotor 20 and the housing end shield 16 as indicated by the spacing arrows. This spacing distance is reduced by turning the screw 26 into the shaft 14 to the position shown in FIG. 2 at which the rotor normally operates with respect to the end of the motor housing 16, which is in the range of 0.001 inch to 0.002 inch. Tightening of the screw forces the shaft spacer 34 from right to left as viewed in FIGS. 1 and 2 and as particularly seen in FIG. 2. Reverse movement, or loosening, of the screw 26 causes the rotor 20 to move away from the housing end shield 16 under the bias of the springs 32 and 33, thereby increasing the axial spacing between the rotor 20 and housing end shield 16.

It should be appreciated that the previously indicated axial clearance of 0.001 inch to 0.002 inch as shown in FIG. 2 of the rotor 20 from the housing 16 is very important in a fluid power device such as a vacuum pump. Any dead air space between the rotor 20 and the housing 16 must be kept to a minimum to minimize direct flow paths between the inlet and outlet ports, past the ends of the vanes and past the motor end of the rotor, for efficient operation. However, contact with the end shield 16 is not permitted, since it is stationary and the rotor and vanes move. The screw 26 in conjunction with the shaft spacer 34 and the spring discs 32 and 33 offer a fine adjustment of the rotor spacing with respect to the motor housing 16, and may also in some cases provide sufficient biasing force to prevent the rotor from rotating relative to the shaft during operation.

It will thus be seen that the invention provides a rotor attachment on a shaft which affords precise adjustment of the rotor with respect to a motor housing, as well as a biasing force during operation of the rotor on a shaft. This is effected with the utilization of available components and without special tooling costs.

It will be apparent to those skilled in the art that variations can be made to the preferred embodiment described without departing from the spirit of the invention. For example, while the rotor adjustment feature has been described in conjunction with a vacuum pump, it could also be utilized in conjunction with other sliding vane devices such as compressors or air motors. The invention should therefore not be limited to the preferred embodiment described, but should be defined by the claims which follow.

We claim:

1. An adjustable attachment for connection of a sliding vane rotor to a shaft comprising:

a housing which defines a compartment therein and including a shaft which extends through said compartment and has an end which extends beyond an end wall of said housing;

a biasing member positioned in the compartment;

a sliding vane rotor mounted coaxially on said end of said shaft outside of said housing so as to rotate with said shaft and be slidable axially relative to said shaft;

an annular shaft spacer axially positioned between said rotor and said biasing member and positioned radially between said shaft and said end wall, said spacer being compressed axially between said rotor and biasing member and having an inner radius in close proximity with said shaft and an outer radius in close proximity with said end wall; and a threaded fastener coaxial with said shaft connecting said rotor to said shaft to exert an axial force on said rotor and spacer member to compress said biasing member so that a spacing between the motor housing and the rotor is adjusted by turning said fastener.

2. The adjustable attachment as defined in claim 1, wherein the threaded fastener is a screw which is threaded into said shaft.

3. The adjustable attachment as defined in claim 1, wherein the biasing member includes at least one belleville spring.

4. The adjustable attachment as defined in claim 3, wherein said biasing member includes at least two belleville springs arranged in face-to-face relationship.

5. The adjustable attachment as defined in claim 4, wherein one of said springs abuts a shoulder on said shaft.

* * * * *